US006073472A

United States Patent [19]

Hollingsworth

[11] Patent Number: 6,073,472

[45] Date of Patent: Jun. 13, 2000

[54] MEASURING TERMINAL CRIMPER

[76] Inventor: Elmont Hollingsworth, 12100 Wander La., Austin, Tex. 78750

[21] Appl. No.: 09/287,883

[22] Filed: Apr. 7, 1999

[51] Int. Cl.[7] ..... H01R 43/042

[52] U.S. Cl. ..... 72/31.01; 72/409.01; 29/720; 29/751

[58] Field of Search ..... 72/409.01, 409.12, 72/409.13, 31.01, 21.4; 29/720, 751

[56] References Cited

U.S. PATENT DOCUMENTS

| | | | |
|---|---|---|---|
| Re. 33,714 | 10/1991 | Anderson et al. | 72/410 |
| 167,835 | 9/1875 | Hobbs . | |
| 3,345,840 | 10/1967 | Beuyukian et al. . | |
| 4,240,280 | 12/1980 | Foslien | 12/410 |
| 4,429,451 | 2/1984 | Angelico | 29/566.4 |
| 4,640,117 | 2/1987 | Anderson et al. | 72/410 |
| 4,794,780 | 1/1989 | Battenfeld | 72/410 |
| 4,809,534 | 3/1989 | Osborn | 72/409 |
| 4,838,134 | 6/1989 | Ruland | 81/467 |
| 4,980,962 | 1/1991 | Wiebe | 29/566.2 |
| 5,012,666 | 5/1991 | Chen et al. | 72/410 |
| 5,101,651 | 4/1992 | Yeomans | 72/19 |
| 5,123,165 | 6/1992 | Strong | 29/720 |
| 5,152,162 | 10/1992 | Ferraro | 29/720 |
| 5,490,406 | 2/1996 | College | 72/30.1 |
| 5,553,478 | 9/1996 | Di Troia | 72/453.15 |
| 5,842,371 | 12/1998 | Liaw | 72/409.12 |

FOREIGN PATENT DOCUMENTS

| | | |
|---|---|---|
| 419129A1 | 3/1991 | European Pat. Off. . |

*Primary Examiner*—Daniel C. Crane
*Attorney, Agent, or Firm*—Felsman, Bradley, Vaden, Gunter & Dillon, LLP

[57] ABSTRACT

A crimping tool comprising a pair of crimping surfaces adapted to crush an article, levers for manually actuating the crimping surfaces, and a scale for controlling a crimp force applied by the levers. The first lever is constructed of a flexible material, and the scale includes a plurality of gradations formed on the first lever, and a pointer mounted such that the pointer moves along the gradations when the first lever is squeezed toward the second lever. The crimping surfaces can be removably attached to the first and second levers.

7 Claims, 2 Drawing Sheets

MEASURING TERMINAL CRIMPER

BACKGROUND OF THE INVENTION

1. Field of the Invention

The present invention generally relates to hand-held devices used to facilitate interconnections, such as crimping tools used to apply terminals to electrical conductors, or interconnect a plurality of conductors, and more particularly to a method and device for controlling the amount of force that is applied when crimping a terminal or wire.

2. Description of Related Art

A variety of tools may be used to facilitate the interconnection of electrical components. Many hand-held crimping tools have been designed for use with electrical wiring and crimp terminals (also referred to as "solderless" connectors). Crimp terminals include, e.g, in-line sleeves or barrels, or C-shaped crimp tubes which can be used to interconnect a plurality of wires, as well as connectors having a barrel or sleeve for securing the terminal end of a single wire or wire strand to an integrally formed contact piece, such as a pin or tab, a socket or slot, or a U-shaped contact. The crimping tools allow a user to apply sufficient force to crush the metallic terminal body against the wiring, which both physically holds the wires together, and provides direct electrical contact between the wires (or indirect electrical connectivity through the conductive terminal body). Crimp connectors are commonly made of copper, aluminum, steel, or an alloy of the foregoing.

Crimping tools for such connectors are often made with generally parallel actuating jaws which are mechanically coupled so as to uniformly apply pressure to the top and portions of a connector. Exemplary designs are shown in U.S. Pat. Nos. 4,794,780, 4,980,962, 5,012,666 and 5,842,371. A typical hand-held terminal crimping tool is depicted in FIG. 1. The crimping tool includes a body 1 having a fixed jaw 6 and a handle portion, and a movable jaw 2 pivotally attached to body 1. The teeth inside the jaws are shaped to correspond to a selected type and size of crimp connector. Movable jaw 2 is also pivotally attached to lever 3 which has another handle portion. A ratchet member 4 is coupled between body 1 and lever 3, and rotates with movement of lever 3 to control the opening angle of movable jaw 2 relative to fixed jaw 6. A release plate 5 pivotally attached to lever 3 is biased by a spring (not shown) into engagement with ratchet member 4. Ratchet member 4 has a release notch 7. When lever 3 is squeezed further after movable jaw 2 has come into forcible contact with fixed jaw 6, release plate 5 is shifted from teeth on ratchet member 4 to release notch 7. Movable jaw 2 can then be moved to its full-open position. An adjustment wheel 10 is fastened to an eccentric shaft 8 by a lock ring 9, and allows adjustment of the spacing between movable jaw 2 and fixed jaw 6.

It is important that a user apply the proper amount of force to a wire or terminal when it is being crimped. If the crimping motion is not fully completed by the tool operator, the electrical connection to the wires will be substandard and perhaps even hazardous since a wire could become loose and exposed, causing a short-circuit or fire.

Conversely, if the operator applies too much pressure, then a crimp connector can become damaged (and likewise hazardous), and tool breakage can even occur. The force applied at a first crimp position very near the tip of the tool jaws may vary from the force applied at a second crimp position closer to the pivot point, given the same force exerted by the user.

Some crimping tools attempt to control the amount of the crimp by limiting the dimension of the teeth/die in the jaws of the tool. These tools assume, however, that the wires and connectors will be the prescribed sizes, but the specifications are not always properly followed. Even if the components are the right sizes, other problems can arise, such as missing strands, or a connector from an alternative manufacturer that is made with a softer (or harder) body material. Merely limiting the dimension does not address these situations (and of course does nothing to ensure that enough force is even used).

Insulated terminal crimping tools for wires in the range of 22 to 10 AWG are made to cover a wide range of barrel design, barrel hardness, barrel thickness, wire size and wire stranding. A simple pair of pliers has the widest range of usage and can terminate most terminals because, with great skill or extensive practice and testing, enough crimping force can be applied to retain the wire without applying too much force to weaken the insulation and cause it to crack or break down under high voltage flashover conditions.

The class of tools that have an over-center or nearcenter toggle mechanism to make it easier to apply a large crimping force repeatably, have a narrower range of terminal/wire applicability. Like the tool shown in FIG. 1, they have a set number of nests or positions and no operator adjustment for the force applied to a given terminal. Accordingly, these tools cannot be used to a wide variety of terminals and wire sizes, particularly terminals from different manufacturer lines.

In light of the foregoing, it would be desirable to provide an improved method and device for crimping terminals, that allows the crimping of a wide range of terminals and wires with predictability, reliability, and repeatability, and without requiring great skill or extensive practice. It would be further advantageous if the tool could be used for a variety of crimping jobs, i.e., not just limited to crimping specific types of electrical connectors. To be commercially viable, the tool must also be relatively inexpensive to manufacture.

SUMMARY OF THE INVENTION

It is therefore one object of the present invention to provide an improved tool for crimping wires and terminals or connectors.

It is another object of the present invention to provide a hand-held crimping tool that satisfactorily controls the amount of force being applied during a crimping operation.

It is yet another object of the present invention to provide such a crimping tool that can easily be adapted for use with a wide range of terminal shapes and sizes.

The foregoing objects are achieved in a crimping tool generally comprising a pair of crimping surfaces adapted to crush an article, means for manually actuating the crimping surfaces, and means for controlling a crimp force applied by the actuating means. The controlling means may include a scale providing an indication of force applied by the actuating means. The actuating means may further includes a first lever and a second lever pivotally attached to the first lever, wherein the first lever is constructed of a flexible material, and the scale includes a plurality of gradations formed on the first lever, and a pointer mounted such that the pointer moves along the gradations when the first lever is squeezed toward the second lever. In one embodiment, the first lever is S-shaped. The crimping surfaces can be removably attached to the first and second levers. The present invention thus allows crimping of a wide range of terminals and wires, while greatly lessening the skill required to successfully use crimpers. The tool can also easily be adapted for other crimping jobs by changing out the crimp dies, and new dies can be provided whenever new terminal designs are placed on the market.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein:

DESCRIPTION OF AN ILLUSTRATIVE EMBODIMENT

Figure 2:
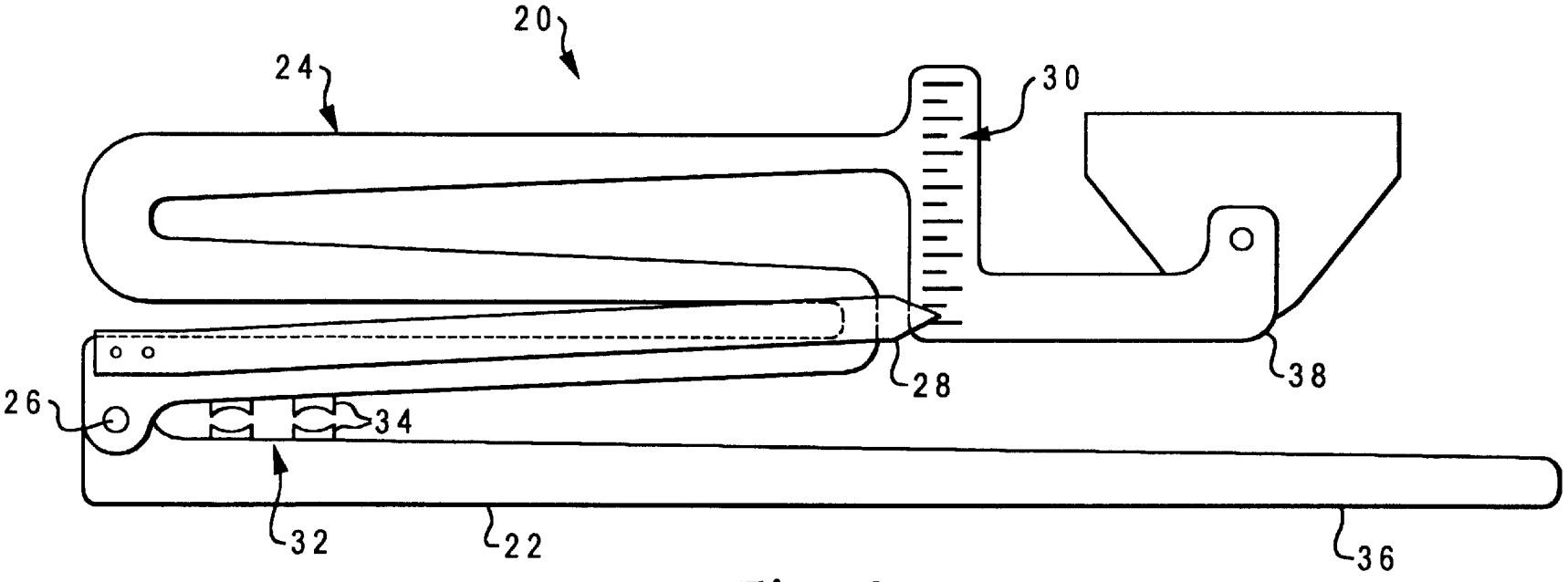
FIG. 2 is an elevational view of one embodiment of a crimping tool constructed in accordance with the present invention, wherein a scale formed on one of the handles provides an indication of the proper amount of force to be applied for a particular crimp terminal or wire.

With reference now to the figures, and in particular with reference to FIG. 2, there is depicted one embodiment 20 of a crimping tool constructed in accordance with the present invention. Crimping tool 20 is generally comprised of a first handle or lever 22, and a second handle or lever 24 which is pivotally connected to handle 22 at pivot point 26. In this embodiment, handle 22 is generally straight, while handle 24 is folded or S-shaped. The handles can have cushioned hand grips (not shown).

A pointer 28 is anchored on lever 24 near pivot point 26 and runs down most of the length of handle 24, terminating proximate a scale 30 formed on handle 24. Scale 30 may be printed, embossed, molded, etc., onto handle 24, and may have numerical gradations, or lines that are identified by successive letters of the alphabet. For example, in the depicted embodiment wherein 15 lines are evenly spaced along scale 30, each line is identified by one of the letters A through O.

A crimping area 32 is located interior from pivot point 26 (i.e., the opposite of a plier-type tool). While the crimping teeth may be fixed to the handles, they are preferably provided in the form of removable dies (anvils) 34, which can be attached to handles 22 and 24 by any convenient means, such as set screws. Multiple dies can be used, i.e., more than one crimping station provided along the handles.

Figure 1:
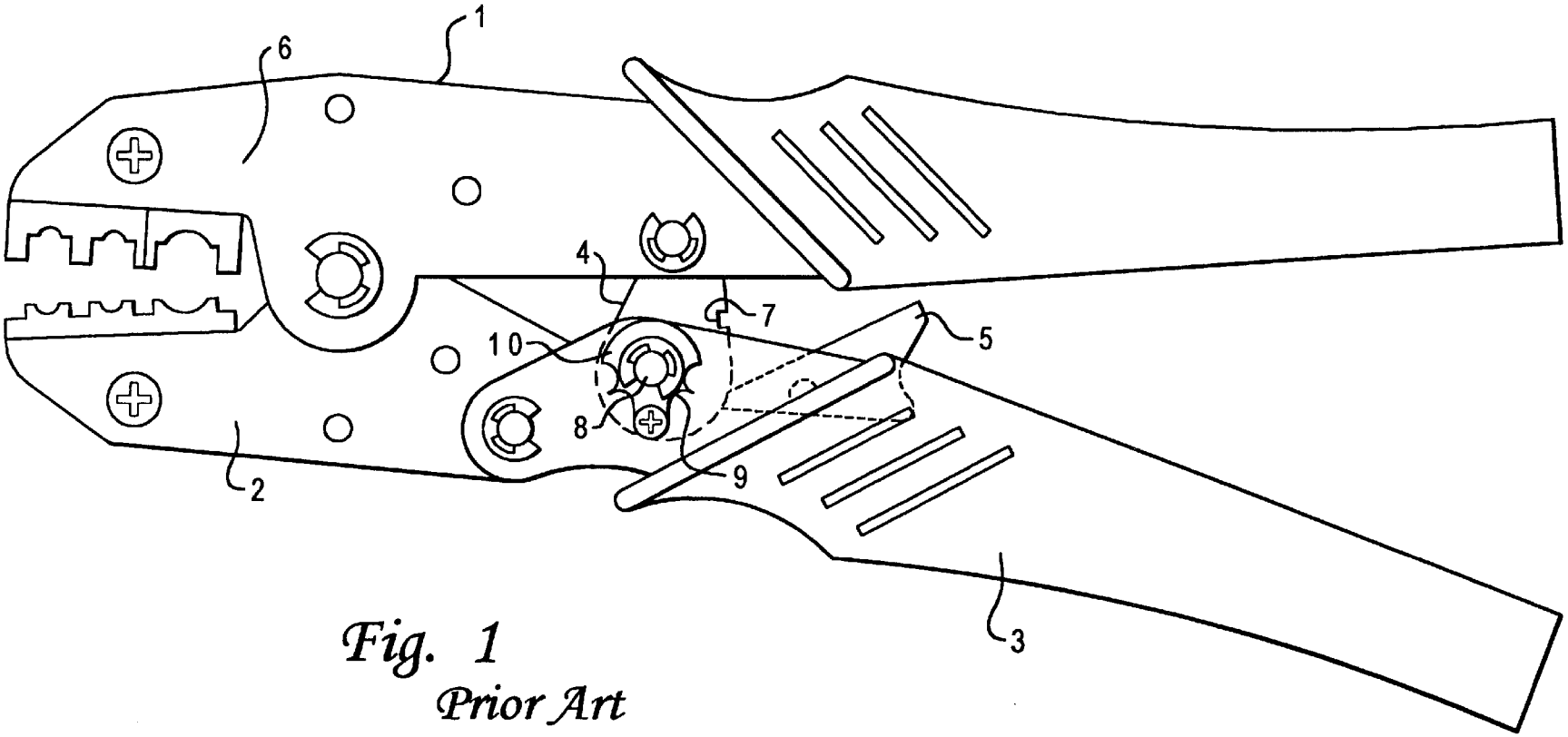
Fig. 1 Prior Art
FIG. 1 is an elevational view of a prior art crimping tool having several pairs of teeth adapted to crimp different sizes of connectors, and to control the crimp dimension.

The amount of pressure exerted at anvils 34 is related to the spring force generated by the S-shaped portion of handle 24. The amount of pressure that is required for a proper crimping operation, based on the wire gauge, terminal brand, type (e.g., solid material, strand, or coax), etc., can be predetermined or calibrated by testing at the factory. For each such connector, the appropriate gradation on the scale can be ascertained and supplied with instructions. In this manner, the operator can read the force being applied to a terminal as that force is applied, by noting the position (deflection) of pointer 28 along scale 30. The operator simply holds the handles at the proper setting (moving the distal ends 36 and 38 toward one another) to achieve a satisfactory crimp (the setting is also based on which crimping station is being used). The spring force may be provided in an alternative manner, e.g., creating an S-shape in the depth dimension (z-axis). Those skilled in the art will further appreciate that other designs may be used to implement the present invention, such as pliers type of crimping tool, long handles and pointer instead of the s-shaped handle, various linkages between the handle and the crimping stations to increase and modify the mechanical advantage between the two. For example, replacing the handle 3 in FIG. 1 with the pointer 28, scale 30, and lever 24 would allow the intelligent setting of the eccentric shaft 8 and or the removal of the ratchet and release mechanism.

The size of tool 20 may vary, but it is generally adapted for manual use, so the following approximate dimensions are exemplary and should not be construed in a limiting sense. Handle 22 is 31 cm long, and the overall length of handle 24 is 24 cm, but the three S-bend portions of handle 24 are 15 cm long. Scale 30 has gradations 3 mm apart, and pointer 28 is 15 cm long. The crimping stations are 25 mm and 40 mm from pivot point 26. The handles may be constructed of any durable engineering material, preferably a common material suitable for springs, such as steel. Anvils 34 are constructed of a hard wear-resistant material such as hardened steel.

The present invention thus allows crimping of a wide range of terminals and wires with improved predictability, reliability, and repeatability. It greatly lessens the skill required to successfully use crimpers and convert the toggle type from a "one size poorly fits some" to a correct crimp for nearly any terminal. The tool could easily be adapted for other crimping jobs by changing out the crimp dies. New dies can be provided whenever new terminal designs are placed on the market.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. For example, while the torque for the force indicator is purely mechanical in the illustrative embodiment, it could alternatively be an electrical strain gauge with a meter or digital readout, a hydraulic load sensor, or a dial displacement indicator. It is therefore contemplated that such modifications can be made without departing from the spirit or scope of the present invention as defined in the appended claims.

What is claimed is:

1. A method of crimping an article, comprising the steps of:

placing the article in a crimping tool having at least one actuation lever constructed of a spring material, a second lever pivotally attached to the actuation lever, and a scale for providing an indication of force applied by the actuation lever, the scale including a plurality of gradations formed on the actuation lever, and a pointer mounted on the crimping tool such that the pointer moves along the scale when the actuation lever is squeezed toward the second lever;

ascertaining a pre-determined crimp force specific to the article; and applying the pre-determined crimp force with the actuation lever using the scale, by squeezing the levers toward one another and forcing the levers at a position to cause the pointer to deflect an amount along the scale corresponding to the pre-determined crimp force.

2. The method of claim 1 further comprising the step of removably attaching a crimp die to the crimp tool, the crimp die selected to correspond with the article.

3. The method of claim 2 wherein said attaching step attaches the crimp die to an interior position with respect to the pivot point.

4. A device comprising:

a pair of crimping surfaces adapted to crush an article;

means for manually actuating said crimping surfaces, including a first lever and a second lever pivotally attached to said first lever, said first lever being constructed of a spring material; and means for measuring and controlling a crimp force applied by said actuating means, including a scale providing an indication of force applied by said actuating means, said scale includes a plurality of gradations formed on said first lever, and a pointer mounted such that said pointer moves along said gradations when said first lever is squeezed toward the second lever.

5. The device of claim 4 wherein said first lever is S-shaped.

6. The device of claim 4 wherein said crimping surfaces are removably attached to said first and second levers.

7. The device of claim 6 wherein said crimping surfaces are attached to said first and second levers at an interior position with respect to a pivot point.

* * * * *

UNITED STATES PATENT AND TRADEMARK OFFICE

CERTIFICATE OF CORRECTION

PATENT NO. : 6,073,472
DATED : Jun. 13, 2000
INVENTOR(S) : Elmont Hollingsworth

It is certified that error appears in the above-identified patent and that said Letters Patent is hereby corrected as shown below:

Column 2, line 25, after "used to" insert --terminate--.

Signed and Sealed this

First Day of May, 2001

*Attest:*

Nicholas P. Godici

NICHOLAS P. GODICI

*Attesting Officer*

*Acting Director of the United States Patent and Trademark Office*